United States Patent [19]

Hafele et al.

[11] 4,029,069

[45] June 14, 1977

[54] FUEL SUPPLY PUMP

[75] Inventors: Walter Häfele, Fellbach; Rudolf Kleeberger, Munich, both of Germany

[73] Assignee: Robert Bosch G.m.b.H., Stuttgart, Germany

[22] Filed: Aug. 27, 1975

[21] Appl. No.: 608,247

[30] Foreign Application Priority Data

Sept. 4, 1974 Germany ..... 2442261
July 12, 1975 Germany ..... 2531188

[52] U.S. Cl. ..... 123/139 R; 285/12; 206/318; 92/15

[51] Int. Cl.[2] ..... F02M 39/00

[58] Field of Search ..... 123/139 R; 206/318, 206/319; 137/316; 285/12; 92/15

[56] References Cited

UNITED STATES PATENTS

| | | | |
|---|---|---|---|
| 2,583,528 | 7/1954 | McFadden | 206/318 |
| 2,733,042 | 1/1956 | Colbertson | 137/316 X |
| 3,412,717 | 11/1963 | Carey | 123/139 R X |
| 3,430,735 | 3/1969 | Collius | 92/15 X |

*Primary Examiner*—Harold W. Weakley
*Attorney, Agent, or Firm*—Edwin E. Greigg

[57] ABSTRACT

The roller shaft which actuates a pumping element in a fuel injection pump is secured against unintentional release during transport by elastic elements, preferably spring wire parts, whose one end engages a stationary portion of the fuel supply pump and whose other end engages a recess or cutout in the roller shaft and cooperates with a shoulder or stop therein to prevent unintentional drop-out while permitting a normal reciprocating motion after installation. Suitable openings and grooves provided in the roller shaft guide can hold and orient the spring wire.

13 Claims, 10 Drawing Figures

FUEL SUPPLY PUMP

BACKGROUND OF THE INVENTION

The invention relates to a fuel supply pump, especially for fuel presupply to an injection pump of an internal combustion engine. The fuel supply pump includes an axially movable roller shaft driven by an external cam and located in the housing of the fuel pump. A releasable mechanism secures the roller shaft within the pump housing.

The external cam used to drive fuel supply pumps of this type is usually located on the cam shaft of the fuel injection pump which is supplied with fuel by the supply pump. The fuel supply pump is usually mounted to a flange of the housing of the fuel injection pump and the roller shaft extends suitably into the housing of the fuel injection pump. However, the driving cam can be any other cam rotating at motor rpm, for example, a cam on the engine crankshaft.

The roller shafts in the fuel supply pumps of the type described above are cylindrical in cross section and thus require additional and, therefore, expensive components and manufacturing steps to secure the roller shaft against rotation and unintentional release. If no mechanism is present which releasably secures the roller shaft against unintentional release (transport security) then the roller shaft may fall into the camshaft space during installation or disassembly of the fuel supply pump and such an event can have serious attendant difficulties. On the other hand, the roller shaft must be easily demountable for purposes of repair.

OBJECT AND SUMMARY OF THE INVENTION

It is an object of the invention to provide a fuel supply pump of the type described above which is not subject to the above cited disadvantages and which permits relatively inexpensive manufacture and an improved security against unintentional release while maintaining a facility for access.

This and other objects are attained according to the invention by providing that the roller shaft is made with a rectangular cross section having flat guide surfaces. The invention further provides that the roller shaft is guided within a guide bushing fixedly mounted within the pump housing. The releasable mechanism which secures the roller shaft against unintentional release is embodied as a stop extending into the rectangular space of the guide bushing. The stop engages a recess provided on the roller shaft forming a stop therefor. It is known to provide roller shafts of rectangular cross section for fuel injection pumps and to equip them with flat guide surfaces. Roller shafts with rectangular cross section have the advantage that they can be manufactured relatively inexpensively in a sintering or a continuous pressing process or may be manufactured, for example, from stock with predetermined profiles so that only very small machining is required while automatically providing security against rotation without the necessity for separate and expensive mechanisms. According to the invention, the roller shaft is guided in a guide bushing which can also be manufactured inexpensively in a sintering, pressing or precision molding process. In this manner separate manufacturing steps for installing the mechanism which secures the roller shaft against unintentional release (transport security) can be eliminated which makes the apparatus relatively inexpensive while remaining functionally reliable.

In a preferred feature of the invention, the recess in the roller shaft is a partial axial groove located in one of the corners of the roller shaft which has a shoulder that forms the seat for the stop. This brings the advantage that when the roller shaft has a square cross section it is impossible to install it with a 90° error of orientation. In addition, for such roller shafts which are made in a sintering or pressing operation, the die which is used for forming the roller shaft is strong and rigid because the part of the die which forms the groove is a solid and substantial part of the die.

The invention provides a simple form for the roller shaft and a favorable embodiment of the tools used in its manufacture by providing that the recess is formed in a preferably rectangular cutout in one jaw of that part of the roller shaft which holds the roller.

A mechanism which secures the roller shaft against unintentional drop-out from the pump may be made simply and inexpensively by providing that the securing bolt is one end of a profiled rod guided along the external wall of the guide bushing which is pressed against the guide bushing by an annular spring which surrounds the guide bushing and lies in a plane perpendicular to the axis. When the profiled rod is made from sheet metal, it is particularly advantageous if one end of the profiled rod has a protrusion which penetrates a recess on that side of the guide bushing which protrudes from the injection pump and extends into the partial axial groove of the roller shaft. The invention also provides that the opposite end of the profiled rod, remote from the securing end, engages a recess on that face of the guide bushing which is nearest the pump housing. The mechanism which holds the roller shaft in the pump housing may be further simplified by providing that the stop is embodied as the bent-over end of a wire which is bent in the direction of the shaft and that the other end of the wire is used for axially securing the guide bushing. For this purpose, the end of the wire is held in the bore of the housing which includes the guide bushing and provides an elastic action in its middle portion.

The invention will be better understood as well as further objects and advantages become more apparent from the ensuing detailed specification of four exemplary embodiments taken in conjunction with the drawing.

DESCRIPTION OF PREFERRED EMBODIMENTS

Figure 1:
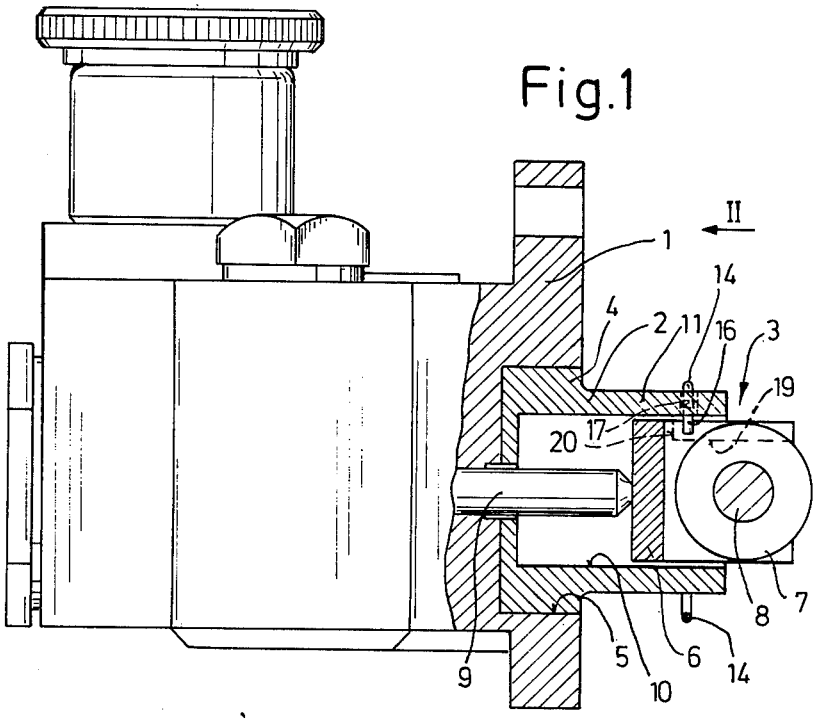
FIG. 1 is a partially sectional view of the first embodiment of a fuel pump according to the invention in which the sectional view corresponds to the section I in FIG. 2.

The housing 1 of a fuel supply pump includes a guide bushing 2 which is unreleasably press-fit and is intended to guide a roller shaft 3. The region 4 of the guide bushing 2 which is nearest the housing 1 has an outside diameter which corresponds with suitable tolerance to the inside diameter of a bore 5 within the housing 1. The roller shaft 3 comprises a shaft body 6 having a rectangular cross section, a roller 7 and a roller axis 8. The transmission of force from the roller shaft 3 to the pump element, which is not shown, takes place via a rod 9. Fuel supply pumps of the type described preferably employ pump pistons as the main pumping element, but the rod may also be used to actuate a pump diaphragm. Matching the cross section of the roller shaft body 6 is an opening inside the guide bushing 2 which is also rectangular and is therefore labeled as a four-cornered chamber 10. Accordingly, the guiding surfaces of the shaft 3 and its guide bushing 2 are planes. The region 11 of the guide bushing 2 facing away from the pump is also rectangular, primarily to conserve raw materials, so that the guide walls for the roller shaft are parallel.

Figure 2:
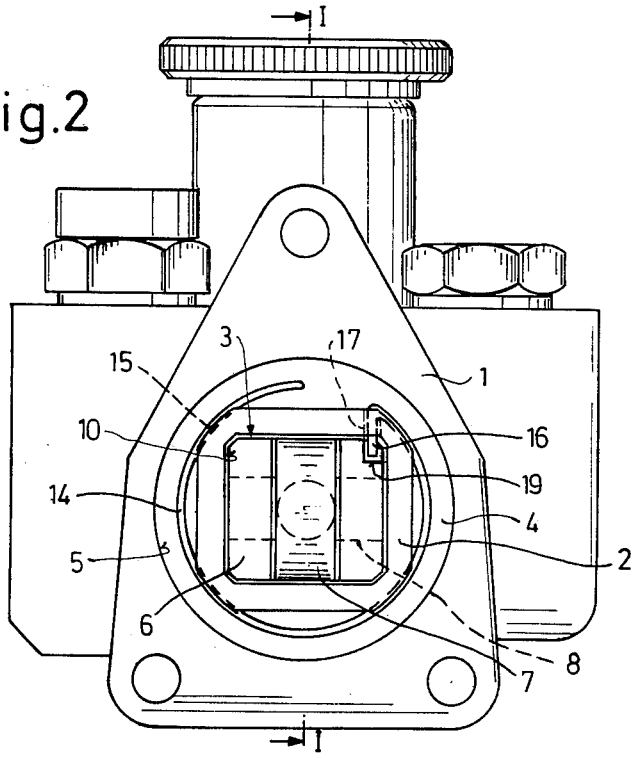
FIG. 2 is an end view of the first exemplary embodiment of the invention seen in the direction of the arrow II in FIG. 1.

In the first embodiment, shown in FIGS. 1 and 2, the region 11 of the guide bushing 2 is surrounded by an annular spring wire 14 which is guided in recesses 15 (see FIG. 2) that are disposed in a plane perpendicular to the roller shaft axis and are located in the corner regions of the portion 11 of the guide bushing 2. One end of the spring wire 14 is sharply bent in the direction of the center of the circle formed by the spring and extends through a bore 17 within the guide bushing 2 into the rectangular space 10 in the guide bushing 2. This spring tip 16 engages a recess within the shaft body 6, embodied as a partial axial groove and thus acting as a stop which secures the roller shaft against falling out of the pump. As may be seen in FIG. 1, the axial groove 19 terminates at a shoulder 20 so that roller shaft 3 may not glide out of the guide bushing 2 as long as the tip 16 of the annular spring 14 is in engagement with the axial groove 19.

Figure 3:
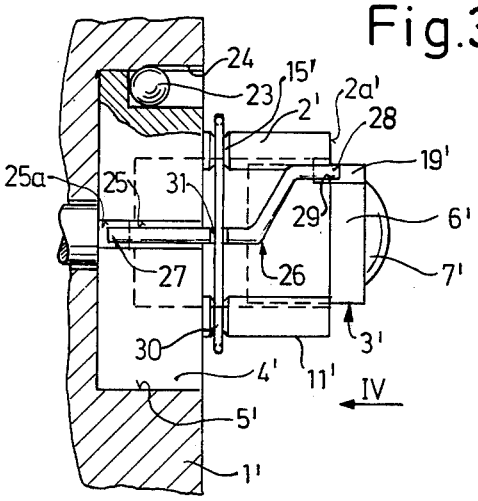
FIGS. 3 and 4 are two views of a second exemplary embodiment according to the invention.
Figure 4:
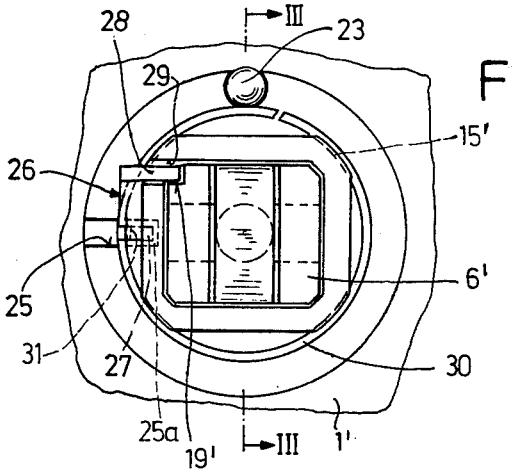

The second exemplary embodiment of the invention is depicted in FIGS. 3 and 4 which uses primed reference numeral for parts which remain identical with those of the first embodiment. FIG. 3 represents a section along the line III—III in FIG. 4 and shows the guide bushing 2′ in a substantially front elevational view and FIG. 4, which corresponds in layout to FIG. 2 of the first exemplary embodiment, shows the guide busing 2′ as seen in the direction of the arrow IV in FIG. 3.

The region 4′ of the guide bushing 2′ which is pressed into the bore 5′ of the housing 1′ is additionally secured, in this exemplary embodiment, by a ball 23 that is pressed into a bore 24 formed both by a recess in the housing 1′ and by a recess in the guide bushing 2′. This ball provides additional support, especially in the rotational direction. Region 4′ of the guide bushing 2′ further includes an axial groove 25 in which lies a profiled rod 26 whose one end 28 acts as a locking bolt and secures the roller shaft 3′ against unintentional release from the pump. The profiled rod 26 is guided in the groove 25 and its end 27, near the fuel pump, engages a recess 25*a* at the bottom of the groove 25 and its end 28, remote from the pump, engages a recess 29 located in the region 11′ of the guide bushing 2′. The recess 29 is open in the direction of the face 2*a* of the shaft guidance and the end 28 extends through the recess 29 is embodied as a protrusion and engages the partial axial groove 19′ of the roller shaft 6′. An annular spring 30 encloses the rectangular region 11′ of the guide bushing 2′ and holds the profiled rod 26 in its position. When the annular spring 30 is released, the profiled rod 26 may be so displaced from the recess 29 that the roller shaft 3′ may be removed. In similar manner as pertained to the spring 14 of the first exemplary embodiment, the annular spring 30 is held at the corners of the region 11′ of the guide bushing 2′ by recesses 15′. The axial position could also be maintained simply by a groove 31 on the profiled rod 26, which would eliminate additional machining of the guide bushing 2′.

Figure 5:
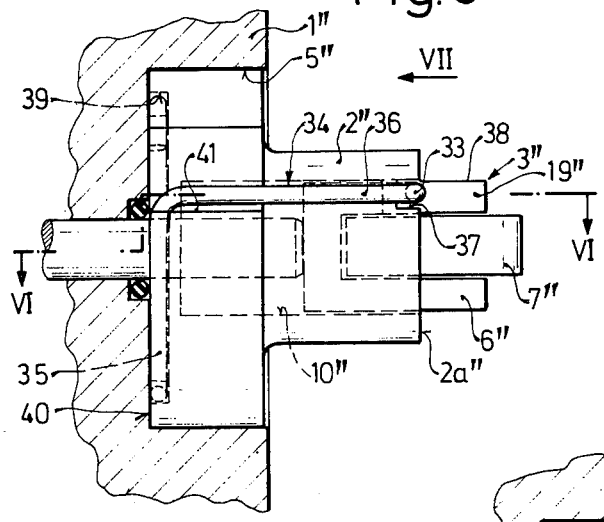
FIGS. 5–7 represent a third embodiment of the invention in various views.
Figure 6:
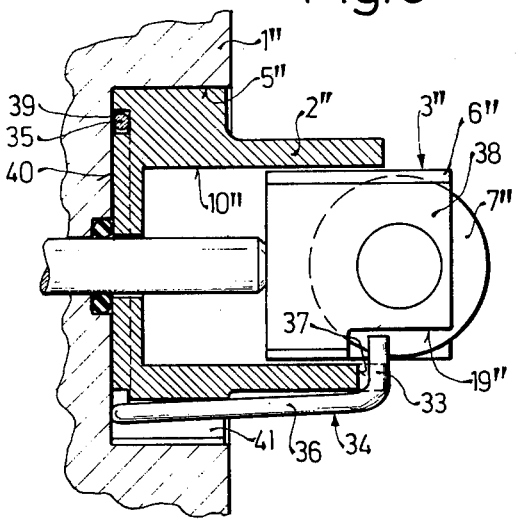
Figure 7:
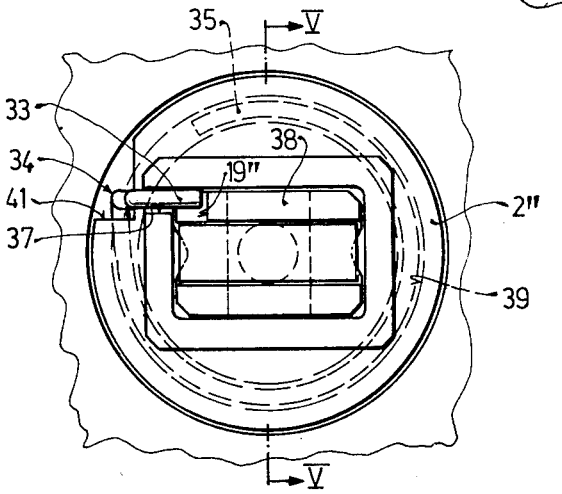

The third exemplary embodiment, shown in FIGS. 5–7, is distinguished from the second exemplary embodiment according to FIGS. 3 and 4 by a further simplified mechanism consisting of a single member which secures the roller shaft against unintentional release. FIGS. 5 and 7 correspond in layout to FIGS. 3 and 4 of the second exemplary embodiment; corresponding reference numerals carry a double prime in this embodiment. FIG. 5 is a cross section along the line V—V in FIG. 7 and FIG. 7 is a view in the direction of the arrow VII in FIG. 5 FIG. 6 is a section along the line VI—VI in FIG. 5. A guide bushing 2″ is pressed into the bore 5″ of the housing 1″. The stop and hence the mechanism to guard against the unintentional release of the roller shaft 3″ from its guide, embodied as a rectangular space 10″, is the end 33 of a bent wire member 34 whose other end 35 serves for the axial positioning of the bent wire member 34 and is held by the guide busing 2″ within the bore 5″. The middle portion 36 of the bent wire part 34 extends substantially parallel to the axis of the pump and is embodied elastically. One end 33 of the bent wire part 34 serves as a locking stop or bolt and is bent away at right angles from the central portion 36. The end 33 then penetrates through a groove 37 which is open in the direction of the face 2*a*″ of the guide bushing 2″, remote from the fuel supply pump, and engages the cutout 19″ of the roller shaft 3″. In contrast to the previous two exemplary embodiments in FIGS. 1–4, in this exemplary embodiment, the recess is not a partial axial groove located on the corners of the roller shaft but rather a rectangular cutout 19″ in one jaw 38 of the part of the roller shaft 6″ which carries the roller 7″. The end 35 of the bent wire part 34 is a ring or ring sector, bent away at right angles from the central part 36 which lies in an annular groove 39 within face 40 of the guide bushing 2″ pressed into the pump housing bore 5″ and performs the axial positioning of the bent wire part 34. The middle portion 36 of the bent wire part 34 is guided through a corner groove 41 located in the region of section 4″ of the guide bushing 2″. The corner groove 41 takes the place of the axial groove 25 of FIGS. 3 and 4 and is formed as part of the guide bushing 2″, which permits the requisite pressing dies to be made very strong. The dismantling of the roller shaft 3″ can take place by disengaging the end 33 of the bent wire part 34 from the cutout 19″ and this disengagement is made possible by the elastic middle portion 36. In the last described embodiment of the device for securing the unintentional release of the roller shaft, there are no removable and releasable parts at all, the elements are inexpensive to manufacture and the guide bushing 2″ requires no additional machining or processing because the annular groove 39 can also be pressed into the guide bushing itself.

Figure 8:
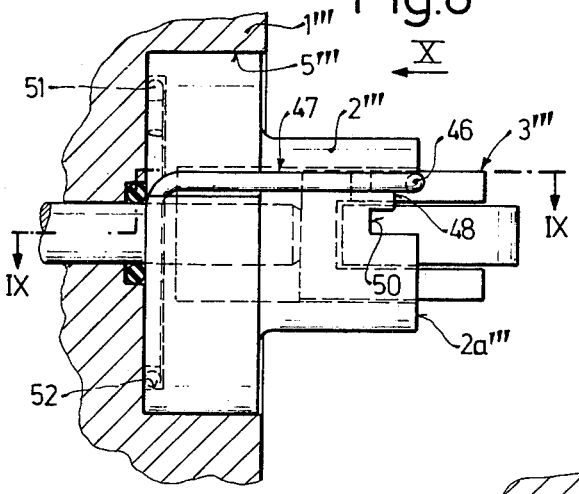
FIGS. 8–10 are various views of the essential elements of the fourth exemplary embodiment according to the invention.
Figure 9:
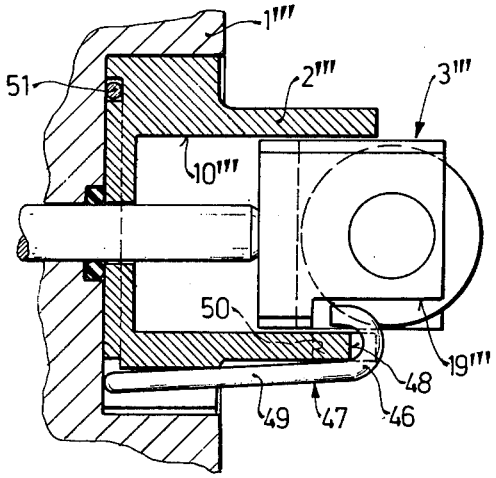
Figure 10:
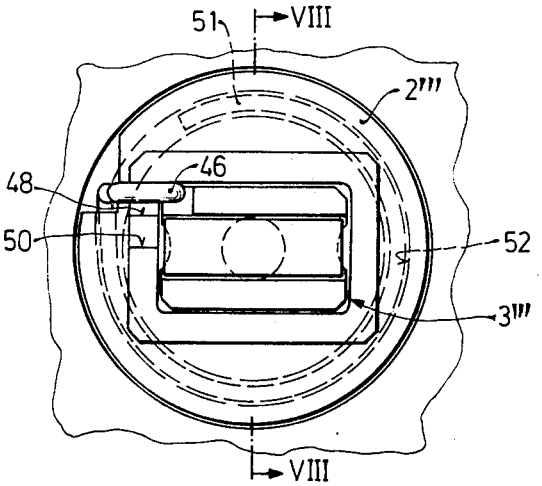

The fourth embodiment of the invention is depicted in FIGS. 8–10 in which reference numerals are identified with triple primes. FIG. 8 shows the pump housing along the line VIII—VIII in FIG. 10 and the remaining elements are shown in elevational view. FIG. 9 is a section along the line IX—IX in FIG. 8 and FIG. 10 is an end view in the direction of the arrow X in FIG. 8.

This fourth exemplary embodiment is substantially similar to the third exemplary embodiment according to FIGS. 5–7. In this embodiment, the guide bushing 2''' and the roller shaft 3''' are suitably formed to match the end 46 of the bent wire part 47 serving as a locking mechanism. The end 46 of the bent wire part 47 which serves as a locking and securing mechanism, as may be seen best in FIG. 9, has a U-shaped bend and is so guided by a groove 48 on the face 2a''' of the guide bushing 2''' that the bent end 46 is locked in its installed position, i.e., is held by the part of the wall of the guide bushing 2''' which is enclosed by the U-shaped end 46. Thus, the bent wire part 47 cannot yield even under high load. When it is intended to dismantle the roller shaft 3''', it is first pushed into the rectangular space 10''' and, subsequently, the end 46 is pushed laterally by means of the elastic middle portion 49 of the bent wire part 47 until the bent end 46 reaches the region of a second and lower groove 50 on the face 2a''' of the guide gushing 2'''. Starting with this position, the end 46 may be pushed from the middle of the pump through the groove 50 to the outside so that the end 46 disengages from the cutout 19''' of the roller shaft 3'''. As may be clearly seen in FIGS. 8 and 10, this second groove 50 lies directly adjacent to one side of the first groove 48. The other end 51 of the bent wire part 47 is bent into an annulus. It is made exactly as the corresponding element in FIGS. 5 and 7 and is held in an annular groove 52 in the guide bushing 2'''.

What is claimed is:

1. A fuel supply pump for the pre-supply of fuel to the fuel injection pump of an internal combustion engine, said fuel supply pump including a housing and an externally actuated axially movable roller shaft, said roller shaft having a substantially rectangular cross section and flat external surfaces, said fuel pump further including releasable means for holding and securing said roller shaft to prevent unintentional release thereof, the improvement comprising:

A. a guide bushing, fixedly attached to said housing and capable of receiving and axially guiding said roller shaft; and B. said releasable means including stop means, extending into said guide bushing and capable of engaging a recess in said roller shaft, thereby limiting the axial motion thereof.

2. A fuel supply pump according to claim 1, wherein said housing has an opening which receives said guide bushing and said guide bushing is press-fit in said opening.

3. A fuel supply pump according to claim 2, wherein said stop means is one end of an annular spring which envelops said guide bushing and lies in a plane perpendicular to the axis of said roller shaft, and said guide bushing has an opening through which said end of said annular spring penetrates and said end of said annular spring engages said recess in said roller shaft.

4. A fuel supply pump according to claim 3, wherein said recess in said roller shaft is a partial axial groove whose terminus is a shoulder which acts as a seat for said stop means.

5. A fuel supply pump according to claim 1, wherein said guide bushing is provided with an outside surface channel, parallel to said roller shaft, and said housing is provided with a complementary inside surface channel, and a ball is inserted in the space formed by said complementary channels for preventing relative rotation of said guide bushing and said housing.

6. A fuel supply pump according to claim 1, wherein said stop means is one end of a bent rod and which further includes an annular spring which lies in a plane perpendicular to the axis of said roller shaft and envelops said guide bushing, thereby pressing said bent rod against said guide bushing.

7. A fuel supply pump according to claim 6, wherein said guide bushing has an opening through which said one end of said bent rod extends and engages said recess in said roller shaft.

8. A fuel supply pump according to claim 6, wherein said guide bushing has a radial channel, located adjacent to said pump housing, and arranged to receive the end of said bent rod remote from said recess in said roller shaft.

9. A fuel supply pump according to claim 1, wherein said roller shaft has a bifurcated end adapted to hold said roller, and said recess is a channel provided in one side of said bifurcated end.

10. A fuel supply pump according to claim 1, wherein said stop means is one end of a sculptured wire and the other end thereof is held between one face of said guide bushing and a surface of said housing, and said sculptured wire is substantially elastic.

11. A fuel supply pump according to claim 10, wherein said guide bushing has a notch opening, located at the end thereof remote from said housing, said one end of said sculptured wire extends substantially perpendicular to the main body thereof and extends substantially radially through said notch opening into said channel in said roller shaft.

12. A fuel supply pump according to claim 11, wherein said other end of said sculptured wire is a partial annulus, lying in a plane perpendicular to the axis of said roller shaft, and wherein the face of said guide bushing near said housing has an annular shoulder for holding said partial annulus.

13. A fuel supply pump according to claim 10, wherein said guide bushing has a first notch through which extends a U-shaped end of said sculptured wire, the tip of said U-shaped end engaging said channel in said roller shaft and said guide bushing has a second notch, adajacent to said first notch and of sufficient size to permit the radial passage of the U-shaped end of said sculptured wire; whereby said roller shaft is prevented from movement out of said guide bushing when said U-shaped end lies in said first notch and said tip engages said recess, but said roller shaft may be removed from said guide bushing when said U-shaped end is radially displaced through said second notch.

* * * * *